US005960714A

United States Patent [19]

Göttling et al.

[11] Patent Number: 5,960,714

[45] Date of Patent: Oct. 5, 1999

[54] ROTARY PRINTING MACHINE WITH CYLINDERS HAVING AN UNCOVERABLE END FACE

[75] Inventors: Josef Göttling, Friedberg; Horst Dauer, Rohrbach; Xaver Bachmeir, Affing-Haunswies; Bernhard Feller, Friedberg, all of Germany

[73] Assignee: Man Roland Druckmaschinen AG, Offenbach, Georgia

[21] Appl. No.: 09/152,804

[22] Filed: Sep. 14, 1998

[30] Foreign Application Priority Data

Sep. 12, 1997 [DE] Germany ..... 197 40 129

[51] Int. Cl.[6] ..... B41F 13/20

[52] U.S. Cl. ..... 101/216

[58] Field of Search ..... 101/141, 152, 101/153, 216, 217, 218, 143, 144, 145, 375, 376, 247

[56] References Cited

U.S. PATENT DOCUMENTS

| | | | |
|---|---|---|---|
| 2,801,584 | 8/1957 | Davidson | 101/216 |
| 3,783,780 | 1/1974 | Saueressig | 101/153 |
| 4,913,048 | 4/1990 | Tittgemeyer | 101/141 |
| 5,060,569 | 10/1991 | Gladow | 101/216 |
| 5,241,905 | 9/1993 | Guaraldi et al. | 101/216 |
| 5,590,597 | 1/1997 | Balow | 101/216 |
| 5,644,982 | 7/1997 | Koura et al. | 101/216 |
| 5,678,485 | 10/1997 | Guaraldi | 101/247 |

FOREIGN PATENT DOCUMENTS

| | | | |
|---|---|---|---|
| 490 994 | 2/1930 | Germany . | |
| 2 314 523 | 10/1974 | Germany | 101/216 |
| 35 43 704 | 6/1987 | Germany . | |
| 196 14 514 | 10/1997 | Germany . | |
| 196 41 805 | 4/1998 | Germany . | |
| 6-191007 | 7/1994 | Japan . | |
| 6-278264 | 10/1994 | Japan . | |
| 7-290684 | 11/1995 | Japan . | |
| 9-183209 | 7/1997 | Japan . | |

*Primary Examiner*—Christopher A. Bennett

*Attorney, Agent, or Firm*—Cohen, Pontani, Lieberman & Pavane

[57] ABSTRACT

A rotary printing machine in which cylinders are uncovered by a swinging door or a removable flap. Journals are separated from the cylinder bodies and remain, together with bearings arranged in the door or the flap. At a separation point the journals have truncated conical projections which are inserted into corresponding truncated conical depressions in the end face of the cylinder body.

9 Claims, 4 Drawing Sheets

ROTARY PRINTING MACHINE WITH CYLINDERS HAVING AN UNCOVERABLE END FACE

BACKGROUND OF THE INVENTION

1. Field of the Invention

The present invention relates to a rotary printing machine with at least one cylinder mounted in the side walls. One of the side walls carries a pivot-mounted door or a removable flap in which the cylinder is mounted via a bearing and by means of which the cylinder can be uncovered at its end face.

2. Description of the Related Art

German reference DE 196 41 805 A1 discloses a rotary printing machine with a swinging door. This printing machine has an offset double printing group with two form cylinders and two rubber-blanket cylinders. In one of the side walls of the printing machine there is a door with two door wings that can be swung so that the cylinder is uncovered at its end face. The journals are fixedly connected to the cylinder bodies, and the bearing and bearing bushes remain on the journal when the cylinder is uncovered.

German reference DE PS 490 994 discloses a cylinder bearing for a cylinder in a rotary printing machine. The cylinder is covered by a sleeve and can be uncovered by removal of a clamping ring. The clamping ring must first be moved away from the cylinder body in a straight line and then can be swung to the side.

German reference DE 35 43 704 A1 discloses a cylinder with bearings in the side walls that can be moved in the direction of the longitudinal axis of the cylinder. Connected to the bearings are truncated conical pressure pieces, which can be removed from corresponding recesses in the endface walls of the cylinder. In this way, the cylinder can be uncovered for the purpose of disassembling the cylinder mantle. In another embodiment, at one end face of the cylinder, a bearing is pivot-mounted around a pivot bearing on the side wall, so that the cylinder can be uncovered on one side for the purpose of removing its sleeve.

The known solutions have various disadvantages, for example, the high precision manufacturing techniques that are necessary to uncover the bearing systems.

SUMMARY OF THE INVENTION

The object of the present invention is to provide a cylinder in a rotary printing machine that can be simply uncovered.

According to the present invention, the journal of the cylinder is separated from the cylinder body at a separation point, which is located between the cylinder body and the side wall. Either the cylinder body or the journal has a truncated conical projection, while the journal or the cylinder body has a corresponding truncated conical depression. The separation point is thus always formed by a conical pair. A plurality of cylinders can also be separated simultaneously in this manner. The journals and bearings of the cylinders remain in the door, which is swung away from the side wall, or in the flap, which is removed from the side wall. Advantageously, according to the present invention, in particular, sleeve-type printing forms can be easily removed from a form cylinder.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

Examples of the invention are described below in reference to the drawings, in which like reference numerals denote similar elements throughout the various views.

DETAILED DESCRIPTION OF THE PREFERRED EMBODIMENTS

Figure 1:
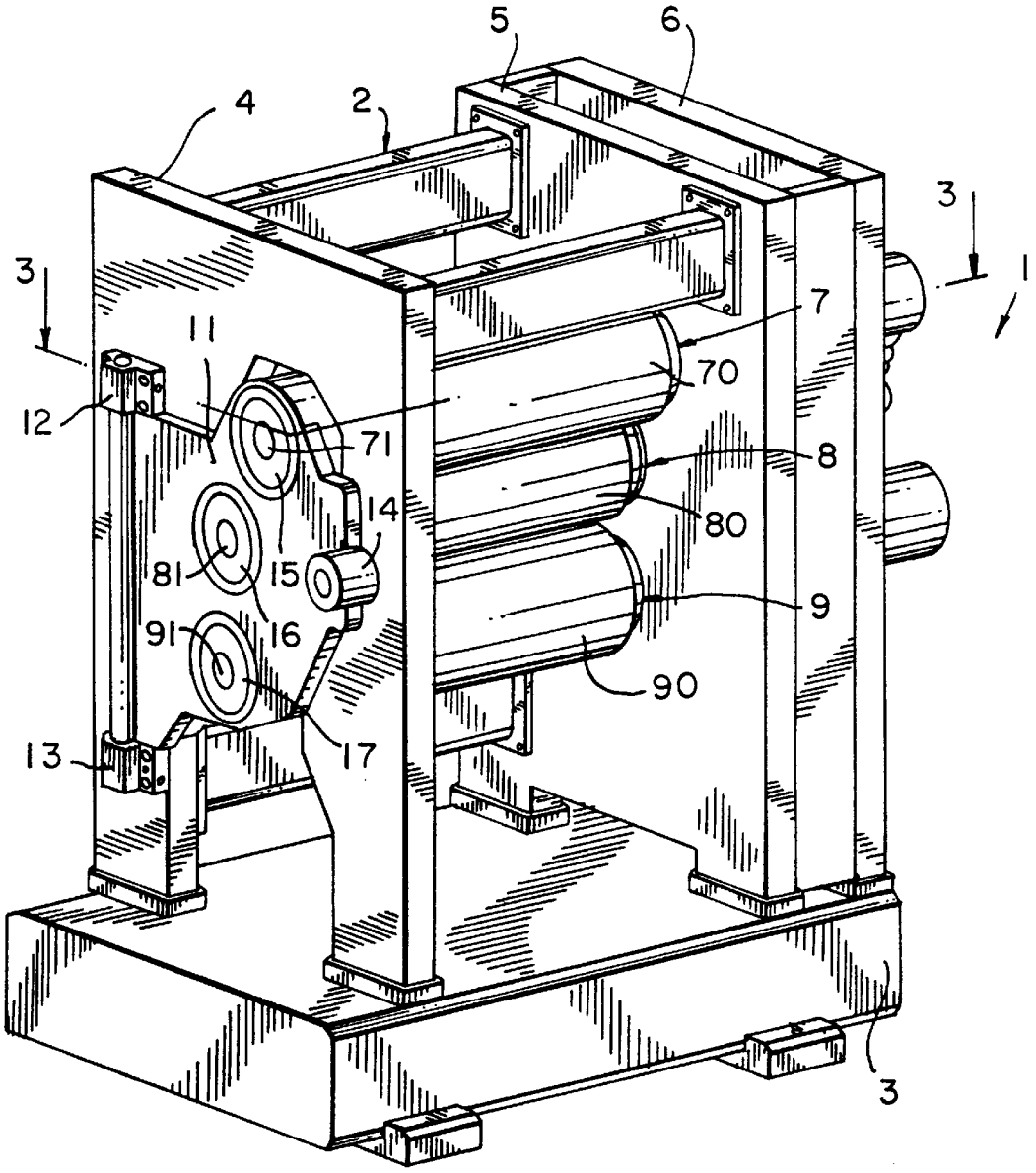
FIG. 1 shows a printing group of a rotary printing machine of the present invention with cylinders uncoverable by means of a door, in the closed state.

A rotary printing machine 1 (FIG. 1) has a printing group 2. The printing group 2 includes a base structure 3 and side walls 4, 5, 6. In the printing group 2 are mounted, as printing cylinders, a form cylinder 7, a transfer cylinder 8 and a pressure cylinder 9. The form cylinder 7, the transfer cylinder 8 and the pressure cylinder 9 have respective cylinder bodies 70, 80, 90 and journals 71, 81, 91. Separation points 10 (FIG. 3) are arranged at the ends of the cylinder bodies 70, 80, 90 so as to detachably connect the cylinder bodies 70, 80, 90 to the journals 71, 81, 91.

Figure 3:
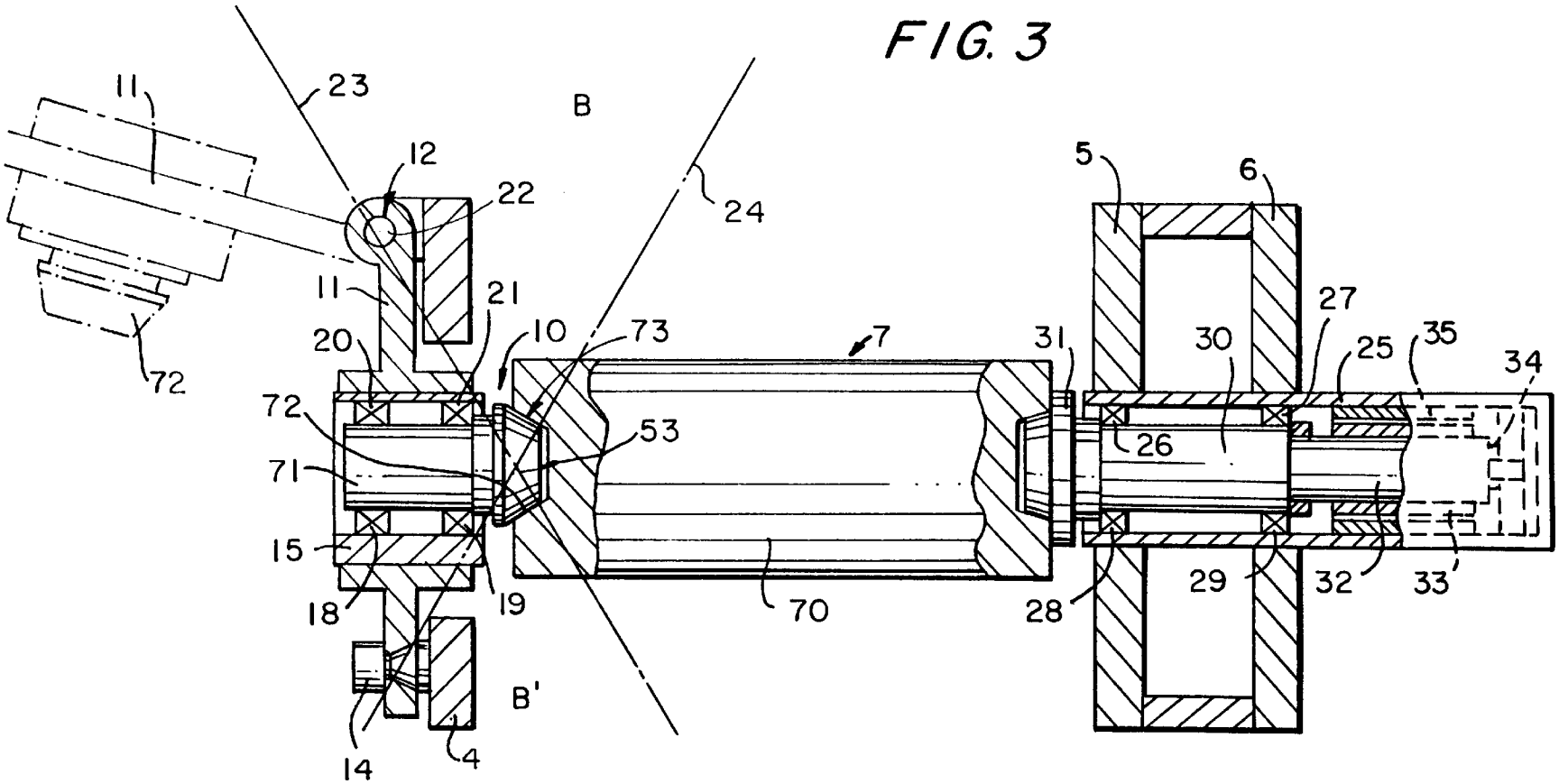
FIG. 3 shows a horizontal cross-section through the printing groups in FIGS. 1 and 2 taken along Line 3—3.

A swinging door 11 is pivotably attached to a first one of the side walls 4 by means of pivot bearings 12, 13. The door 11 is arrestible on the first side wall 4 by means of a lock 14. First eccentrics 15, 16, 17 are rotatably mounted in the door 11 so as to support the journals 71, 81, 91 at the door 11. The first eccentrics 15, 16, 17 therefore enable the cylinders 7, 8, 9 to be moved into and out of position. Bearings 18, 19, 20, 21 are provided to mount the respective journals 71, 81, 91 in the eccentrics 15, 16, 17 (FIG. 3).

Respective truncated conical projections 72, 82, 92 are configured at ends of the journals 71, 81, 91 proximal the separation point 10. Corresponding truncated conical depressions 73, 83, 93 are configured in the cylinder bodies 70, 80, 90 at the separation point 10.

The truncated conical projections 72, 82, 92, are insertible, by the swinging movement of the door 11, into the associated truncated conical depressions 73, 83, 93. Alternatively, the journals 71, 81, 91 can have truncated conical depressions, while the cylinder bodies 70, 80, 90 have corresponding truncated conical projections.

With respect to the separation point 10, a pivot point 22, configured as the axis of the pivot bearings 12, 13 must lie within an area B formed by verticals 23, 24, which stand vertically on the truncated conical projections 72, 82, 92. A forward edge 53 is arranged at the projections 72, 82, 92 in the direction of the respective truncated conical depressions 73, 83 and 93 in the cylinder bodies 70, 80, 90. When, instead of the journals 71, 81, 91, it is the cylinder bodies 70, 80, 90 that have truncated conical projections, while the journals have corresponding depressions, the reverse is true in reference to area B. The pivot point can also lie in area B', which corresponds in mirrored fashion to the area B.

Corresponding to the first eccentric bearing of the form cylinder 7 in the door 11, there is a second eccentric 25 (FIG. 3) that penetrates the other side walls 5, 6. Respective corresponding eccentrics are arranged on the transfer and pressure cylinders 8, 9.

Another journal 30 is mounted in the eccentric 25 via bearings 26–29, the journal 30 being fixedly connected to the cylinder body 70. In an alternative embodiment, a roller socket 31 is provided so as to detachably mount the journal 30 to the cylinder body 70. A stub staff 32, is attached to an end of the journal 30 distal the cylinder body 70. An internal rotor motor 34 is provided so as to drive the form cylinder 7, the internal motor 34 having a rotor 33 which is carried by the stub shaft 32. The transfer and pressure cylinders 8, 9 are driven in a corresponding manner. In an embodiment of the present invention, the cylinders 7, 8, 9 are driven by a shared drive, being connected to one another, for example, by gearwheels.

Preferably, the truncated conical projections 72, 82, 92 are not seated in the depressions 73, 83, 93 in a positive-locking fashion. Rather, the projections 72, 82, 92 preferably are configured of an elastic material having a slight oversize, so as to be securely seated in the cylinder body 70, 80, 90. Elastic compression of the material enables the projections to be removed from the cylinder bodies 70, 80, 90. Supply lines for a pressurized medium are arranged on conical walls of the depressions 73, 83, 93 in the cylinder bodies 70, 80, 90.

In a further embodiment, the supply lines, in conjunction with an associated pressure measurement device, are used to determine whether the conical walls of the projections 72, 82, 92 are tightly seated in the depressions 73, 83, 93. The medium is for example pressurized air. If pressurized air escapes through a gap between the conical walls, then secure seating of the projections 72, 82, 92 in the depressions 73, 83, 93 has not yet been attained.

Figure 2:
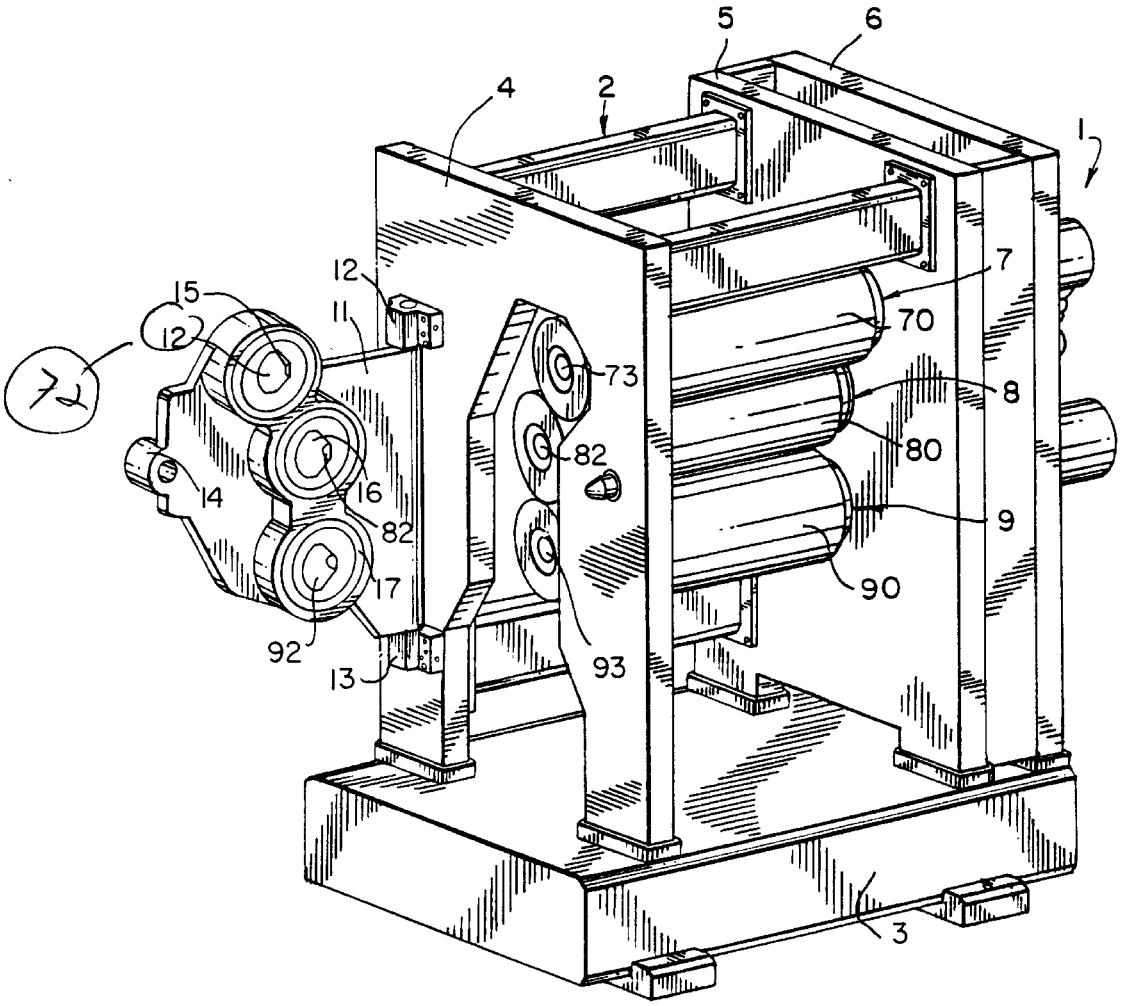
FIG. 2 shows the printing group in FIG. 1, in the opened state.
Figure 4:
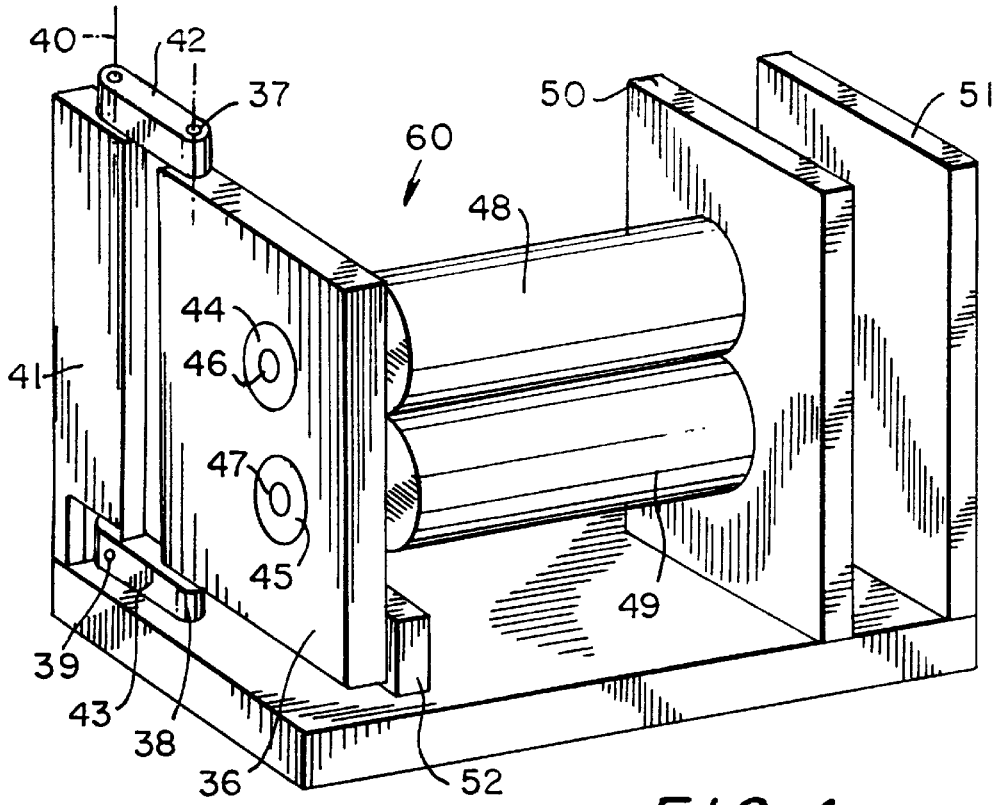
FIG. 4 shows a cylinder pair in a rotary printing machine of another embodiment of the present invention that can be uncovered by a door with two pivot bearings.

Alternatively to the embodiment shown in FIGS. 1 to 3, a swinging door 36 (FIG. 4) is mounted in a first side wall 41 via first and second double pivot bearings 37, 38, 39, 40. The first pivot bearings 37, 38 are attached to the swinging door 36 and the second pivot bearings 39, 40 are attached to the first side wall 41. The first pivot bearings 37, 38 are connected via intermediate pieces 42, 43 to the second pivot bearings 39, 40. Journals 46, 47 of cylinders 48, 49 are mounted in eccentrics 44, 45 in the door 36. The cylinders 48, 49 are mounted on the opposite side in second side walls 50, 51. The use of the double pivot bearings 37–40 advantageously permits easier opening and closing of the door 36. The door 36 strikes a fixed stop 52 and can be secured thereto during printing operation, for example, by means of a lock.

Figure 5:
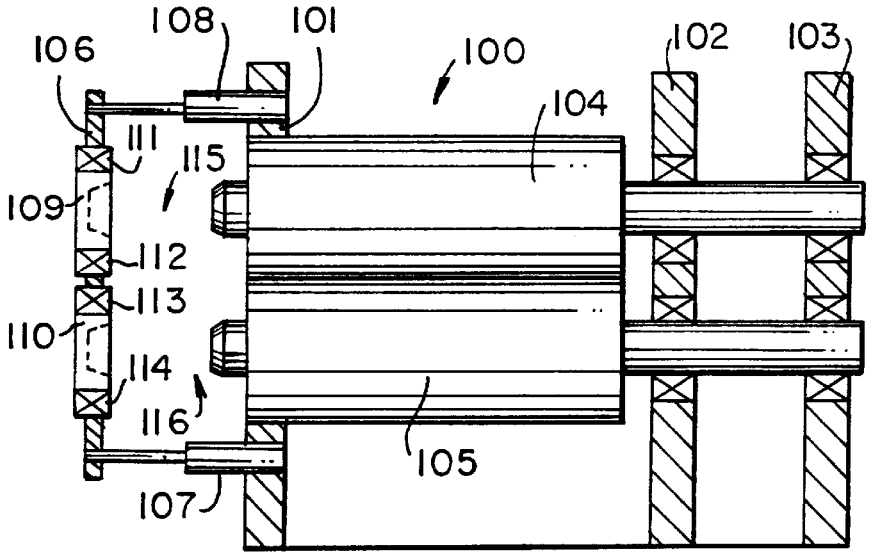
FIG. 5 shows a printing group of a printing machine of a further embodiment of the present invention, with cylinders that can be uncovered by means of a flap, in the opened state.

In yet another embodiment, a printing machine 100 (FIG. 5) has cylinders 104, 105 mounted in side walls 101, 102, 103. A flap 106 is provided at a first one of the side walls 101 so as to uncover an end face of the cylinders 104, 105 facing the first side wall 101. The flap 106 is operated, for example, by means of pneumatic or hydraulic cylinders 107, 108. Journal parts 109, 110 of the cylinders 104, 105 are mounted in bearings 111–114, arranged in the flap 106. When the flap 106 is removed from the side wall 101, the journal parts 109, 100 and the bearings 111–114 remain in the flap 106.

Separation points 115, 116 between the journal parts 109, 110 and the sections of the journals remaining on the cylinders 104, 105 have corresponding truncated conical shapes. The angle that the conical walls form relative to the longitudinal axis of the printing cylinder is for example, 30° in both cases.

The present invention therefore provides printing groups 2, 60 and a rotary printing machine in which cylinders 7, 8, 9, 48, 49; 104, 105 can be uncovered by means of a swinging door 11, 36 or a removable flap 106. The journals 71, 81, 91 are separated from the cylinder bodies 70, 36 or a removable flap 106. The journals 71, 81, 91 are separated from the cylinder bodies 70, 80, 90 and remain, together with the bearings 18–21, in the door 11, 36 or the flap 106. At the separation point 10, the journals 71, 81, 91 have truncated conical projections 72, 82, 92, which are inserted into truncated conical depressions 73, 83, 93 in the end face of the cylinder body 70, 80, 90.

The invention is not limited by the embodiments described above which are presented as examples only but can be modified in various ways within the scope of protection defined by the appended patent claims.

What is claimed is:

1. A rotary printing machine, comprising:

side walls;

at least one cylinder mounted in the side walls and having a journal and a cylinder body;

a door mounted in one of the side walls in swingable fashion;

bearing means arranged at the door for supporting the journal of the cylinder so that an end face of the cylinder facing the door can be uncovered by swinging of the door; and means for separating at least part of the journal from the cylinder body together with the bearing by swinging the door, the separating means being arranged at the end face of the cylinder facing the door and including a conical pair of truncated conical projections and corresponding truncated conical depressions.

2. The rotary printing machine according to claim 1, and further comprising double pivot bearings arranged in the side wall so as to swingably mount the door to the side wall.

3. The rotary printing machine according to claim 1, wherein the truncated conical projections have a slight oversize relative to the corresponding truncated depressions configured in the cylinder bodies.

4. The rotary printing machine according to claim 1, wherein the truncated conical projections have conical walls, and further comprising, a pressurized medium and pressure measurement means for detecting a flat contact of the conical walls of the truncated conical projections with the corresponding truncated conical depressions.

5. The rotary printing machine according to claim 1, and further comprising eccentrics in the side walls, the cylinder being mounted in the eccentrics.

6. A rotary printing machine, comprising:

side walls;

at least one cylinder mounted in the side walls and having a journal and a cylinder body;

a flap removably mounted in one of the side walls; and a bearing mounted at the flap, the cylinder being mounted to the bearing, the cylinder having a separation point configured at an end face of the cylinder facing the flap, the separation point including a conical pair having truncated conical projections and corresponding truncated conical depressions whereby at least part of the journal is separable from the cylinder body and removable together with the bearing by means of the flap.

7. The rotary printing machine according to claim 6, wherein the truncated conical projections have a slight oversize relative to the corresponding truncated depressions configured in the cylinder bodies.

8. The rotary printing machine according to claim 6, wherein the truncated conical projections have conical walls, and further comprising a pressurized medium and pressure measurement means for detecting a flat contact of the conical walls of the truncated conical projections with the corresponding truncated conical depressions.

9. The rotary printing machine according to claim 6, and further comprising eccentrics provided in the side walls, the cylinder being mounted in the eccentrics.

* * * * *